US009347316B2

(12) United States Patent
Shook et al.

(10) Patent No.: US 9,347,316 B2
(45) Date of Patent: May 24, 2016

(54) TELESCOPIC MINE ROOF SUPPORT

(71) Applicant: BURRELL MINING PRODUCTS, INC., New Kensington, PA (US)

(72) Inventors: Michael T. Shook, New Kensington, PA (US); Charles C. Lash, Apollo, PA (US)

(73) Assignee: BURRELL MINING PRODUCTS, INC., New Kensington, PA (US)

( * ) Notice: Subject to any disclaimer, the term of this patent is extended or adjusted under 35 U.S.C. 154(b) by 0 days.

(21) Appl. No.: 14/508,032

(22) Filed: Oct. 7, 2014

(65) Prior Publication Data

US 2015/0267536 A1 Sep. 24, 2015

Related U.S. Application Data

(63) Continuation of application No. 13/599,428, filed on Aug. 30, 2012, now Pat. No. 8,851,805.

(51) Int. Cl.

| | |
|---|---|
| ***E21D 15/18*** | (2006.01) |
| ***E21D 15/14*** | (2006.01) |
| ***E21D 15/00*** | (2006.01) |
| ***E21D 15/44*** | (2006.01) |
| ***E21D 15/48*** | (2006.01) |

(52) U.S. Cl.

CPC ..... *E21D 15/14* (2013.01); *E21D 15/00* (2013.01); *E21D 15/18* (2013.01); *E21D 15/44* (2013.01); *E21D 15/486* (2013.01)

(58) Field of Classification Search

CPC ..... E21D 15/18
USPC ..... 405/288, 290, 291
See application file for complete search history.

(56) References Cited

U.S. PATENT DOCUMENTS

| | | | |
|---|---|---|---|
| 31,777 | A | 3/1861 | Boynton |
| 82,663 | A | 9/1868 | Walters |
| 87,016 | A | 2/1869 | Walters |
| 456,646 | A | 7/1891 | Clark |

(Continued)

FOREIGN PATENT DOCUMENTS

| | | | |
|---|---|---|---|
| CN | 95107473 | A | 1/1996 |
| CN | 202531206 | U | 11/2012 |

(Continued)

OTHER PUBLICATIONS

Yield test report, conducted by NIOSH Safety Structures Testing Laboratory for Jennmar Corporation, relating to Big John Yield Props, Feb. 5, 2002, pp. 1-15.

(Continued)

*Primary Examiner* — Sunil Singh
(74) *Attorney, Agent, or Firm* — Morriss O'Bryant Compagni, PC

(57) ABSTRACT

A longitudinally yieldable support for underground roof support includes a first support section with a first elongate outer shell filed with a solid compressible filler material and a second support section filled with a second solid compressible filler material with a second elongate outer shell extending above the first elongate outer shell. The second support section has density that is greater than a density of the first solid compressible filler material. A pair of attachment members are coupled to the second elongate outer shell and are configured for lifting the second elongate outer shell relative to the first elongate outer shell and for securing the second elongate outer shell relative to the first elongate outer shell once lifted.

23 Claims, 14 Drawing Sheets

(56) References Cited

U.S. PATENT DOCUMENTS

| | | | | |
|---|---|---|---|---|
| 614,729 | A | 11/1898 | Lally | |
| 881,609 | A | 3/1908 | Nellen | |
| 987,397 | A | 3/1911 | Pittroff | |
| 1,895,053 | A | 1/1933 | Staley | |
| 1,971,051 | A | 8/1934 | Reiner | |
| 2,510,688 | A | 6/1950 | Evans | |
| 3,188,041 | A | 6/1965 | Town | |
| 3,196,061 | A | 7/1965 | Paulson | |
| 3,648,960 | A | 3/1972 | Krekeler | |
| 4,052,029 | A | 10/1977 | Townsend | |
| 4,167,361 | A | 9/1979 | Petro | |
| 4,185,940 | A | 1/1980 | Spies | |
| 4,192,479 | A | 3/1980 | Friebe | |
| 4,195,111 | A | 3/1980 | Rautenbach | |
| 4,249,837 | A | 2/1981 | Spies | |
| 4,255,071 | A * | 3/1981 | Koppers | E21D 15/02 248/354.1 |
| 4,277,204 | A | 7/1981 | Koppers | |
| 4,281,487 | A | 8/1981 | Koller | |
| 4,309,059 | A | 1/1982 | Walsh | |
| 4,332,512 | A | 6/1982 | Heintzmann et al. | |
| 4,425,057 | A | 1/1984 | Hahn | |
| 4,497,597 | A | 2/1985 | Chlumecky | |
| 4,520,980 | A | 6/1985 | Townsend | |
| 4,534,531 | A | 8/1985 | Brown | |
| 4,565,469 | A | 1/1986 | Chlumecky | |
| 4,664,563 | A | 5/1987 | Christman | |
| 4,712,947 | A | 12/1987 | Thom | |
| 4,726,714 | A | 2/1988 | MacArthur | |
| 4,770,564 | A | 9/1988 | Dison | |
| 4,773,792 | A | 9/1988 | Landers | |
| 4,915,339 | A | 4/1990 | Halbich | |
| 4,983,077 | A | 1/1991 | Sorge | |
| 5,013,157 | A | 5/1991 | Mills | |
| 5,015,125 | A | 5/1991 | Seegmiller | |
| 5,051,039 | A | 9/1991 | Heiliger | |
| 5,143,340 | A | 9/1992 | Wood | |
| 5,143,484 | A | 9/1992 | Deul | |
| 5,165,824 | A * | 11/1992 | Corcoran | E21D 15/18 248/354.2 |
| 5,273,378 | A | 12/1993 | Merz | |
| 5,308,196 | A | 5/1994 | Frederick | |
| 5,342,150 | A | 8/1994 | Kitchen | |
| 5,400,994 | A | 3/1995 | Shawwaf | |
| 5,413,436 | A | 5/1995 | Merz | |
| 5,669,739 | A | 9/1997 | Clarke | |
| 5,720,581 | A | 2/1998 | Bacon | |
| 5,772,169 | A * | 6/1998 | Blockley | E04B 9/20 248/333 |
| 5,868,527 | A | 2/1999 | King | |
| 5,921,718 | A | 7/1999 | Kolk | |
| 6,056,480 | A | 5/2000 | Kolk | |
| 6,196,635 | B1 | 3/2001 | Rohaly | |
| 6,394,707 | B1 * | 5/2002 | Kennedy | E21D 15/18 248/354.2 |
| 6,499,916 | B2 | 12/2002 | Marianski | |
| 6,558,085 | B1 | 5/2003 | Hall | |
| 6,655,877 | B2 | 12/2003 | Calhoun | |
| 6,910,834 | B2 | 6/2005 | Harbaugh | |
| 7,232,103 | B2 | 6/2007 | Heath | |
| 7,909,542 | B2 | 3/2011 | Erasmus et al. | |
| 8,052,352 | B2 | 11/2011 | Bolton | |
| 8,246,276 | B2 * | 8/2012 | Bower et al. | 405/289 |
| 8,851,805 | B2 | 10/2014 | Shook et al. | |
| 2002/0136607 | A1 | 9/2002 | Merz | |
| 2003/0194280 | A1 | 10/2003 | Calhoun | |
| 2004/0240948 | A1 | 12/2004 | Harbaugh et al. | |
| 2007/0092344 | A1 * | 4/2007 | Erasmus et al. | 405/288 |
| 2011/0262231 | A1 | 10/2011 | Hussey | |
| 2012/0009023 | A1 | 1/2012 | Bower | |
| 2013/0108376 | A1 | 5/2013 | McCartney | |
| 2013/0149044 | A1 | 6/2013 | Barnett | |
| 2014/0064859 | A1 | 3/2014 | Shook | |

FOREIGN PATENT DOCUMENTS

| | | | |
|---|---|---|---|
| DE | 2410976 | | 9/1974 |
| EP | 0040096 | A1 | 11/1981 |
| EP | 0089403 | A1 | 9/1983 |
| EP | 0128964 | A1 | 12/1984 |
| EP | 0160133 | A1 | 6/1985 |
| GB | 2070666 | A | 9/1981 |
| GB | 2070666 | a * | 9/1981 |
| GB | 2081340 | A | 2/1982 |
| GB | 2125465 | A | 3/1984 |
| GB | 2149440 | A | 6/1985 |
| GB | 2330596 | A | 4/1999 |
| WO | 9534743 | A1 | 12/1995 |
| WO | 9850683 | A1 | 11/1998 |
| WO | 0114692 | A1 | 3/2001 |
| WO | 2011133798 | A1 | 10/2011 |
| WO | 2012016272 | A1 | 2/2012 |
| WO | 2012056393 | A1 | 5/2012 |
| ZA | 763597 | | 6/1976 |
| ZA | 763598 | | 6/1976 |
| ZA | 775286 | | 8/1977 |
| ZA | 775348 | | 9/1977 |
| ZA | 784964 | | 3/1978 |
| ZA | 784881 | | 8/1978 |
| ZA | 785331 | | 9/1978 |
| ZA | 787331 | | 12/1978 |
| ZA | 802821 | | 5/1980 |
| ZA | 804801 | | 8/1980 |
| ZA | 805978 | | 9/1980 |
| ZA | 806817 | | 11/1980 |
| ZA | 806944 | | 11/1980 |
| ZA | 812905 | | 5/1981 |
| ZA | 814868 | | 7/1981 |
| ZA | 814869 | | 7/1981 |
| ZA | 815000 | | 7/1981 |
| ZA | 815001 | | 7/1981 |
| ZA | 815002 | | 7/1981 |
| ZA | 815085 | | 7/1981 |
| ZA | 815169 | | 7/1981 |
| ZA | 815170 | | 7/1981 |
| ZA | 836147 | | 8/1983 |
| ZA | 836286 | | 8/1983 |
| ZA | 838402 | | 11/1983 |
| ZA | 838403 | | 11/1983 |
| ZA | 847218 | | 9/1984 |
| ZA | 847219 | | 9/1984 |
| ZA | 852380 | | 3/1985 |
| ZA | 860510 | | 1/1986 |
| ZA | 860723 | | 1/1986 |
| ZA | 877215 | | 9/1987 |
| ZA | 901210 | | 2/1990 |
| ZA | 901984 | | 3/1990 |
| ZA | 910910 | | 2/1991 |
| ZA | 915093 | | 7/1991 |
| ZA | 927149 | | 9/1992 |
| ZA | 933156 | | 5/1993 |
| ZA | 934418 | | 6/1993 |
| ZA | 961864 | | 3/1996 |
| ZA | 974419 | | 5/1997 |
| ZA | 977556 | | 8/1997 |
| ZA | 978946 | | 10/1997 |
| ZA | 984887 | | 6/1998 |
| ZA | 20001460 | | 3/2000 |
| ZA | 20002789 | | 6/2000 |
| ZA | 20029937 | | 12/2002 |

OTHER PUBLICATIONS

Product information brochure produced by Burrell Mining Products International, Inc. for "The Can Cribbing System.", undated.

Product information sheet produced by Strata Products (USA), Inc. for "Propsetter Yieldable Support System.", undated.

* cited by examiner

TELESCOPIC MINE ROOF SUPPORT

CROSS-REFERENCE TO RELATED APPLICATION

This application is a continuation of U.S. patent application Ser. No. 13/599,428, filed on Aug. 30, 2012, now U.S. Pat. No. 8,851,805, the entirety of which is incorporated by reference.

BACKGROUND

DESCRIPTION OF THE RELATED ART

Over the past several years, Burred Mining Products, Inc. of New Kensington, Pa. has successfully marketed and sold a mine roof support product sold under the trademark THE CAN®. THE CAN support is comprised of an elongate metal shell that is filled with aerated concrete. The use of aerated concrete in THE CAN support allows the support to yield axially in a controlled manner that prevents sudden collapse or sagging of the mine roof and floor heaving. THE CAN support yields axially as the aerated concrete within the product is crushed and maintains support of a load as it yields.

A typical size of THE CAN support is approximately six feet (1.8 meters) in height and two feet (0.6 meters) in diameter. The overall height of THE CAN supports is based on the average size of the mine entry with each support being of a height that is less than an average height of the mine entry in which the supports are to be installed. In order to install each support, wood planks (or other appropriate cribbing materials such as aerated concrete blocks) are placed beneath THE CAN support to level the support and additional wood planks or other cribbing materials are placed on top of the support until the space between the support and the roof is filled. Essentially, the cribbing materials are tightly wedged between the support and the roof so as to cause each THE CAN support to bear a load of the roof upon installation. Even though these cribbing materials can be installed by mine personnel in a manner that ensures that each support begins bearing a load of the mine roof upon installation, there still exists a need in the industry to provide a mine roof support that is capable of being installed in a manner that substantially fills the space between the mine roof and the mine floor without requiring the installation of cribbing materials above the roof support. In addition, even though cribbing materials may be tightly inserted between the top of the mine roof support and the roof of the mine, there is still an amount of movement of the mine roof relative to the mine floor (or vise versa in the case of floor heaving) that can occur before the mine roof support is able to fully bear the load. Thus, there still exists a need in the art to provide a mine roof support that is capable of bearing a load of the mine roof support shortly after installation but before the roof begins converging toward the floor or vise versa.

Thus, it would be advantageous to provide a mine roof support that is installable within a mine entry that substantially fully extends between the mine roof and the mine floor when properly installed. It would be a further advantage to provide a mine roof support that is installable within a mine entry that is capable of bearing a load of the mine roof shortly after installation without the need of cribbing materials placed above the support in order to decrease installation time and to increase the initial load bearing capacity of the mine roof support.

These and other advantages will become apparent from a reading of the following summary of the invention and description of the illustrated embodiments in accordance with the principles of the present invention.

SUMMARY OF THE INVENTION

Accordingly, a support is comprised of first elongate tube containing a crushable or compressible core material that allows controlled yielding of the support along its length. A second elongate tube is coupled to the first elongate tube. The second elongate tube is movable in a telescopic manner relative to the first elongate tube and can be filled in situ with a crushable or compressible core material that allows controlled yielding of the support along the second elongate tube once the compressible core material in the first tube has been substantially compressed. By being able to raise the second tube relative to the first tube, the support of the present invention is provided with a length adjustment feature.

In one embodiment, the support is comprised of a first outer steel shell formed in the shape of an elongate tube. An aerated or other lightweight concrete or cement is poured into the elongate tube to substantially fill the entire length of the tube. Once the concrete is set, the concrete will bond to the inside surface of the tube so as to prevent the concrete from disengaging from the tube during transport or use. The use of a lightweight cement containing lightweight aggregate or air pockets allows the cement to be crushed within the outer shell thus allowing axial yielding of the support along its length as the lightweight concrete is compressed.

In another embodiment, a longitudinally yieldable support is comprised of a first support section having a first elongate outer shell filled with a first solid compressible filler material and a second support section having a second elongate outer shell extending above the first elongate outer shell. The second elongate outer shell has an outer diameter that is different than a diameter of the first elongate outer shell to allow the second elongate outer shell to slide relative to the first elongate outer shell. The second elongate outer shell is filled with a second solid compressible filler material having a density that is greater than a density of the first solid compressible filler material.

In one embodiment, a pair of attachment members are coupled to the second elongate outer shell and are configured for lifting the second elongate outer shell relative to the first elongate outer shell and for securing the second elongate outer shell relative to the first elongate outer shell once lifted.

In another embodiment, the second elongate outer shell is comprised of steel and is movable from a first position in which the second elongate outer shell is at least partially disposed within the first elongate outer shell to a second position in which a portion of the second elongate outer shell is positionable between the first elongate outer shell and a roof of a mine entry with a lower portion of the second elongate outer shell disposed within the first elongate outer shell.

In yet another embodiment, the second elongate outer shell is comprised of steel and is movable from a first position in which the second elongate outer shell is at least partially disposed over the first elongate outer shell to a second position in which a portion of the second elongate outer shell is positionable between the first elongate outer shell and a roof of a mine entry with a lower portion of the second elongate outer shell disposed over the first elongate outer shell.

In still another embodiment, the first compressible filler material has a first density and the second compressible filler material is comprised of a solidified compressible material having a second density that is greater than the first density of the first compressible filler material.

In yet another embodiment, the pair of attachment members are each comprised of an elongate strap that is coupled to the second elongate outer shell by wrapping around a lower end thereof and further comprises a securing portion for securing the second elongate outer shell relative to the first elongate outer shell.

In another embodiment, the attachment portion of each of the pair of attachment members laterally extends relative to a top end of the second elongate outer shell and is configured for attachment to a roof of a mine entry.

In still another embodiment, each of the pair of attachment members are bent over a top edge of the first elongate outer shell to maintain the second elongate outer shell relative to the first elongate outer shell.

In another embodiment, the first compressible filler material has a density of between about 40 and 50 lb/ft$^3$ and the second compressible filler material has a density of between about 50 and 60 lb/ft$^3$.

In yet another embodiment, the first support section will yield first under load until a first yield limit is reached at which time the second support section will begin to yield.

In another embodiment, the first support section is capable of supporting a load of between approximately 100,000 lbs and 300,000 lbs as the first support section yields under load.

In still another embodiment, the second outer shell will fold upon itself as the second support section yields.

BRIEF DESCRIPTION OF THE DRAWINGS

The foregoing summary, as well as the following detailed description of the illustrated embodiments is better understood when read in conjunction with the appended drawings. For the purpose of illustrating the invention, there is shown in the drawings several exemplary embodiments which illustrate what is currently considered to be the best mode for carrying out the invention, it being understood, however, that the invention is not limited to the specific methods and instruments disclosed. In the drawings.

DETAILED DESCRIPTION OF THE ILLUSTRATED EMBODIMENTS

Figure 1:
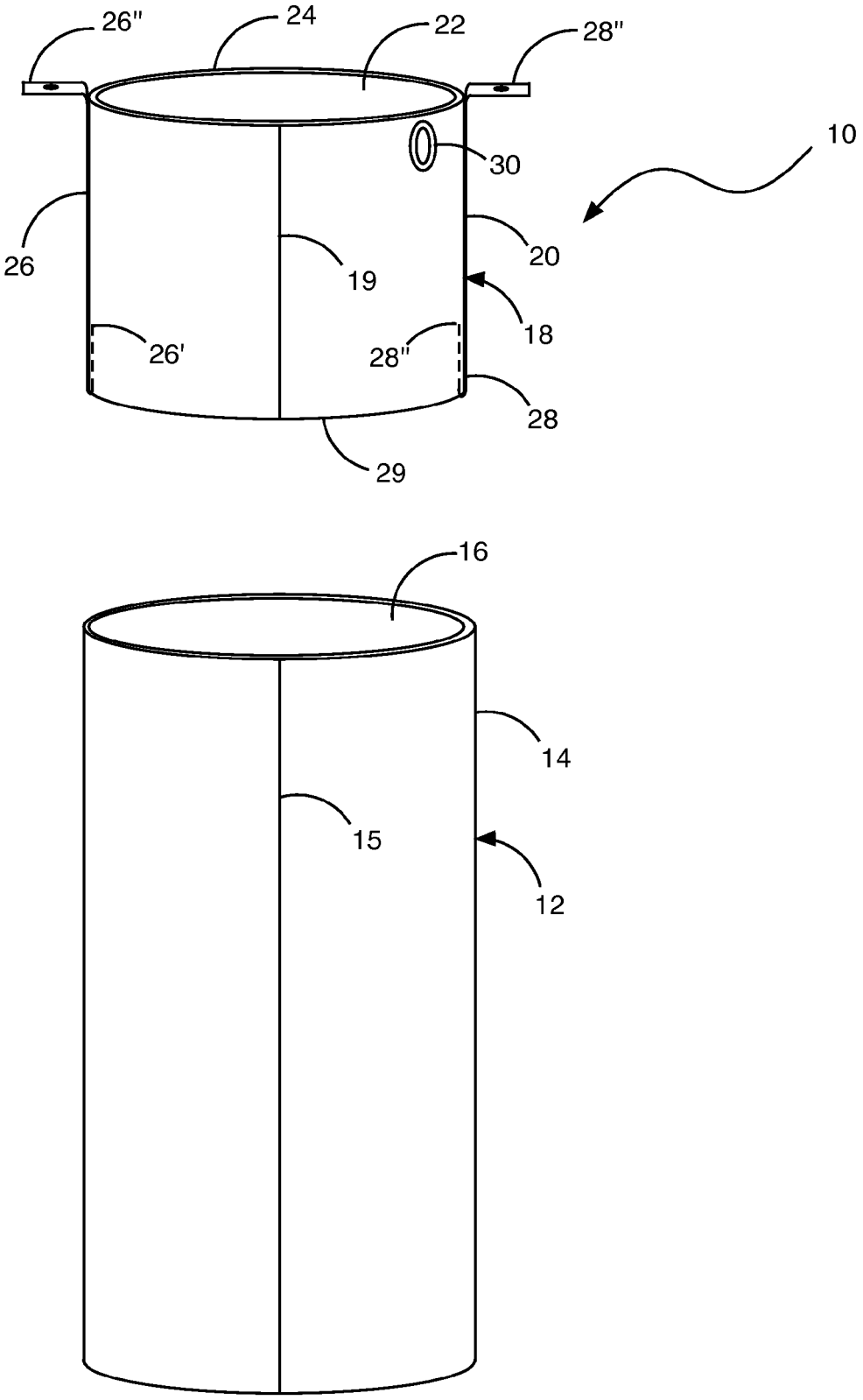
FIG. 1 is a perspective side view of a first embodiment of a support in accordance with the principles of the present invention.

FIG. 1 illustrates a first embodiment of a mine roof support in exploded form, generally indicated at 10 in accordance with the principles of the present invention. The support 10 may be utilized in various underground support situations including without limitation underground mine roof support, various tunnel applications or the like. The support 10 is comprised of a primary support section 12 that is comprised of an outer shell 14 in the form of a tube that is prefilled with a primary compressible filler material 16, such as an aerated concrete aerated grout, foam or other suitable material known in the art and a secondary support section 18 that is coupled to the primary support section 10 in a telescopic manner. The outer shell 14 may be comprised of a sheet of metal, such as steel, that is rolled into a cylinder and welded along a seam 15 that extends the longitudinal length of the outer shell 14. The secondary support section 18 is comprised of an outer shell 20 that is subsequently filled in situ once the support 10 is positioned in a desired location within a mine entry to support the roof of the mine e and control convergence between the floor and the roof of the mine entry. The secondary support section 18 is also comprised of a sheet of a metal, such as steel, that is roiled into a cylinder and welded along a seam 19 that extends the longitudinal length of the outer shell 20. Once positioned, the secondary support section 18 is lifted to be in contact with the roof of the mine entry and filed with a secondary compressible filler material 22 such as aerated concrete, aerated grout, foam or other suitable materials known in the art. The filler materials 16 and 22 provide the principle load bearing capabilities of the support 10 while the outer shells 14 and 20 provide secondary longitudinal or load bearing support while also maintaining adequate hoop strength of the mine support 10 to prevent any significant lateral or radial expansion of the filler materials 16 and 22 as the support 10 is compressed. Thus, the tube 12 and filler material 16 work in tandem as the support 10 yields under load to allow vertical or longitudinal compression of the support 10 while maintaining support of the load. That is, the support 10 will longitudinally yield for a given displacement or yield dimension without catastrophic failure under load.

Aerated or "foamed" concrete or cement is particularly beneficial because it can be cast in the outer shell 14 substantially along its entire length and the strength or compressibility characteristics of the foamed concrete are relatively uniform and predictable to produce a desired compressive strength to weight ratio. The use of foamed concrete, in which small air cells are formed within the concrete, in the primary support section 12 is well proven and has been reliably used in roof supports for years. In addition, once set, foamed concrete once cured forms a solidified, unitary structure that will remain contained within the outer shell 14 during handling and will not settle within the outer shell 14, as may be the case when using loose materials, such as saw dust or pumas. In a support application, settling of the filler material 16 is a major concern since any settling will result in larger displacement or yielding of the support before the support begins to carry a load.

As previously mentioned, while cylindrical supports in the form of the primary support section 12 have been successfully used in underground mines for a number of years, the space between the top of the support and the roof must be occupied with a material that will transfer the forces applied by the roof to the support without any significant lag between when the roof moves and the support begins bearing a load. Most commonly, wood planks have been stacked on top of the support and effectively wedged to the best extent possible between the roof and the support. As movement within the mine entry occurs, the wood planks are compressed until they effectively begin bearing a load and can fully transfer that load to the support. Moreover, as the space between the support and the roof increases, more wood is required between the roof and the support. As more wood is stacked upon the support, the roof of the mine can move a greater distance before the support will begin fully supporting the load. Ideally, a load supported by a support should be fully supported within approximately the first inch (2.5 centimeters) of movement.

In order to maximize the load bearing capability of the support 10 of the present invention, the secondary support section 18 is telescopically coupled to the primary support section 12. In use (as will be described in more detail), the secondary support section 18 can be lifted relative to the primary support section 12 until the top 24 of the secondary support section 18 abuts against the roof. The overall length of the secondary support section 18 is such that when raised relative to the primary support section 12, the bottom portion of the secondary support section 18 is still engaged with the primary support section 12. Once raised, the secondary support section 18 is then filled with the filler material 22. Attachment members 26 and 28 are coupled to the secondary support section 18 and are provided for both lifting the secondary support section 18 from the primary support section 12 and for securing the secondary support section in its lifted position until the secondary support section 18 is filled with the filler material 22, as through filling port 30 in the upper portion of the secondary support section 18. The filling port 30 may comprise a one-way valve that allows the filler material 22 to be pumped into the outer shell 20 while preventing the filler material 22 from exiting through the port 30 when the nozzle being used to fill the outer shell 20 is removed. By using a nonflammable filler material, such as aerated concrete, lightweight grout, self-hardening foam or other materials known in the art, the support 10 provides a significant improvement over prior art supports that utilize wood products alone or in combination with other nonflammable support structures. In the case of a fire, any supports that are made in whole or in part from wood could fail as the fire burns any flammable materials from the support. With the present invention, the supports are more likely to remain in place and continue to support the roof even during a fire. Furthermore, use of filler materials that are not susceptible to shrinkage continue to support the roof even after long periods of time.

The attachment members 26 and 28 are formed from elongate steel straps that are bent and wrapped around the bottom edge 29 of the outer shell 20 with the distal ends 26' and 28' upwardly extending within the outer shell 20. The proximal ends 26" and 28" extend to the top end 24 of the outer shell 20 and are outwardly bent to form attachment tab portions. The attachment tab portions are provided with a hole so that the proximal ends 26" and 28" can be bolted to the roof at least until the outer shell is filled with the filler material 22 and the filler material 22 has adequately cured so as to hold the outer sleeve 20 in position.

Figure 2:
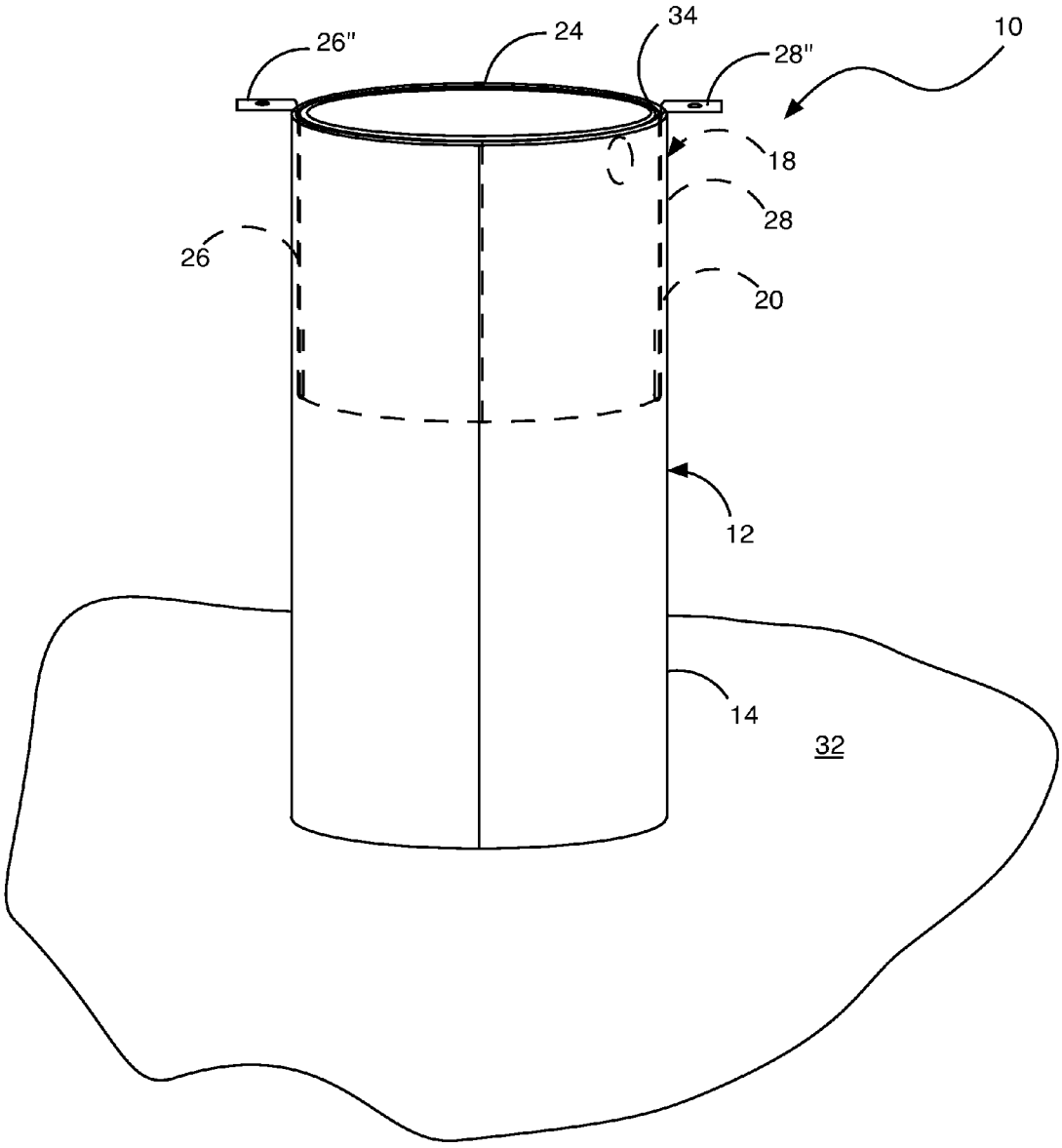
FIG. 2 is a perspective side view of the support shown in FIG. 1 in a collapsed state.
Figure 3:
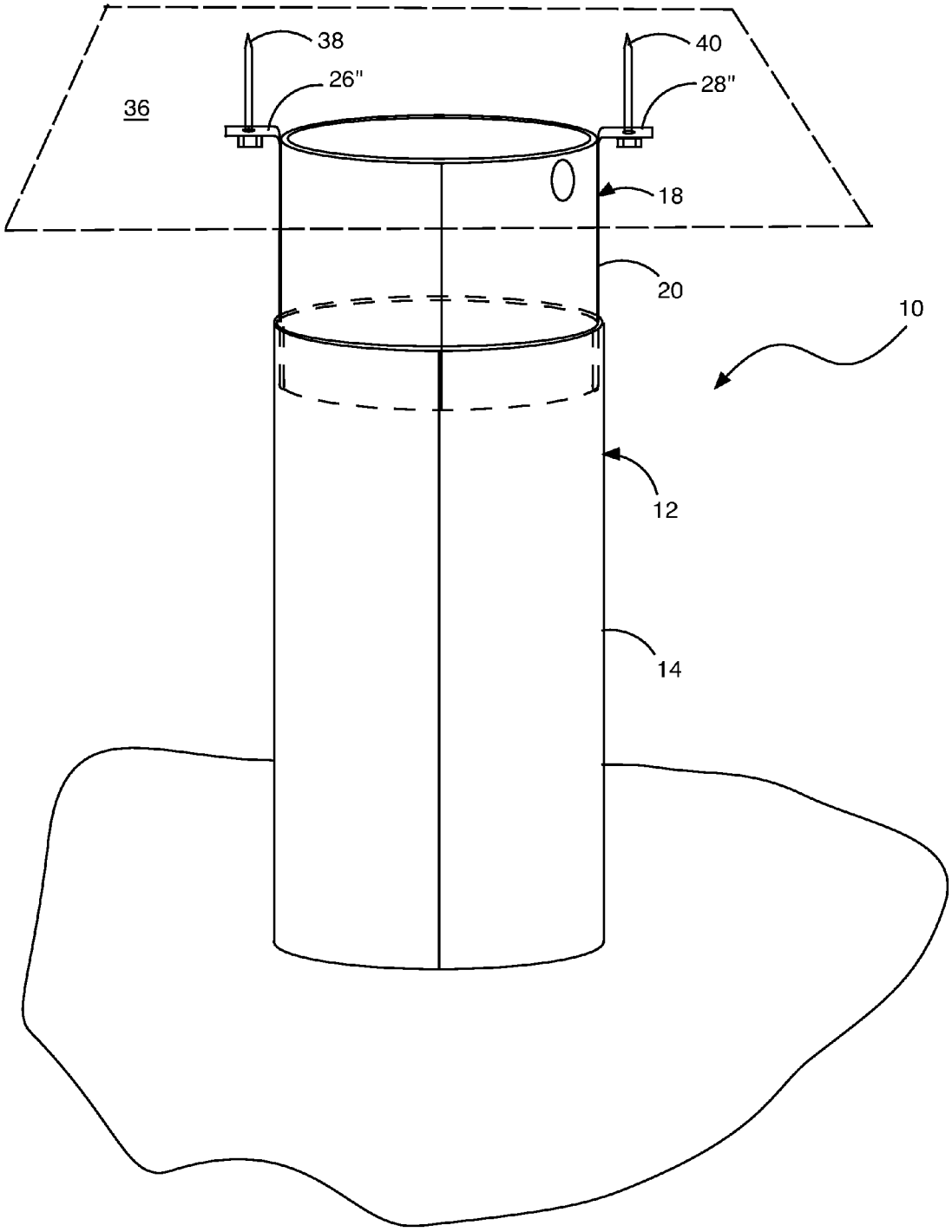
FIG. 3 is a perspective side view of the support shown in FIG. 1 in an extended state.

Referring now to FIG. 2, there is illustrated the support 10 in a collapsed position where the outer shell 20 of the secondary support section 18 is positioned or disposed within the primary support section 12. The outer shell 20 of the secondary support section 18 may be fully, substantially (i.e., with a small portion or few inches of the outer shell 20 exposed) or partially disposed (i.e., with several inches of the outer shell 20 exposed) within the primary support section 12. The outer shell 20 has an outer diameter that is slightly smaller (e.g., 0.125-0.5 inch smaller or less) than the inner diameter of the outer shell 14 of the primary support section 12. This allows the support 10 to be transported and moved into position while protecting the outer shell 20 of the secondary support section 18 from being damaged and to provide the support 10 in a more compact state. The attachment members 26 and 28 are positioned along the outer side of the outer shell 20 between the outer shell 20 and the outer shell 14. Thus, a small gap 34 is defined between the outer shell 14 and the outer shell 20 to accommodate the thickness of the attachment members 26 and 28 that extends through the gap 34 along the sides of the outer shell 20 of the secondary support section 18. It should be noted that during transport, the laterally extending tabs 26" and 28" may be folded downward against the outer surface of the outer shell 14 of the primary support section 12 and then upwardly bent to be generally horizontal as shown to provide a grip for lifting or raising the outer shell 20 relative to the primary support section 12 until the top edge 24 of the outer shell 20 abuts against the roof. Once placed on a support surface 32, such as the floor of a mine entry where the support 10 is to be installed, the secondary support section 18 can then be lifted in a telescoping manner from the primary support section 12 until the top edge 24 of the secondary support section 18 abuts against the roof (not shown). Lifting of the outer shell 20 relative to the primary support section 12 may be facilitated by breaking the outer shell 20 free during the manufacturing process. That is, when the filler material of the primary support section 12 is nearly cured, the outer shell 20 can be moved by twisting and/or lifting until loosened to make raising or lifting the outer shell in situ (i.e., in position for being used as an underground support) easier for mine personnel. The support 10 is configured to rest directly on the support surface 32 without the need for wood cribbing or the like in order to provide a non-flammable support 10 over its entire length when installed in a mine entry or other underground tunnel where support is required.

Figure 4:
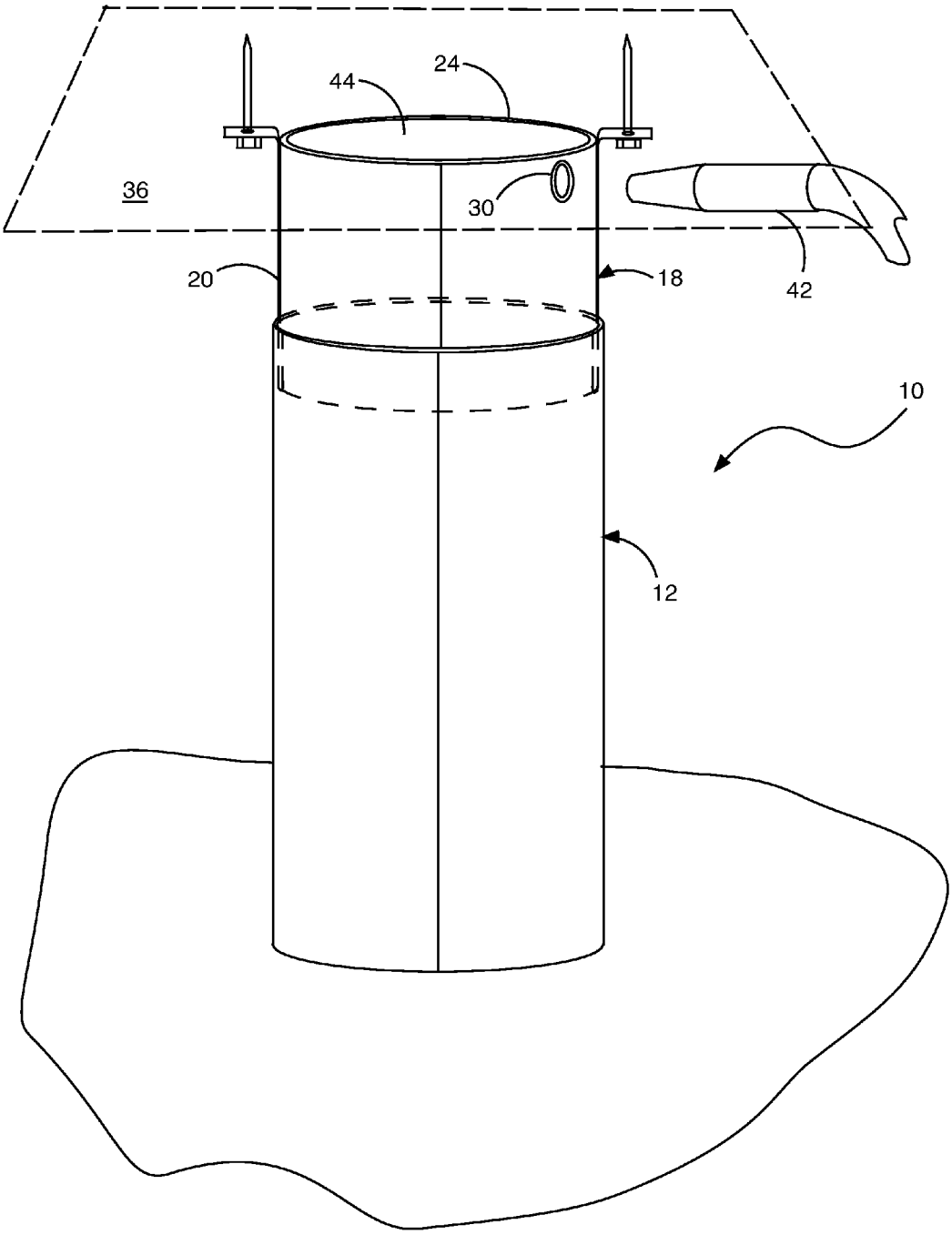
FIG. 4 is a perspective side view of the support shown in FIG. 1 in an extended state.

As further illustrated in FIG. 4, the support 10 can be temporarily or permanently attached to the roof 36 (represented by dashed lines) with a pair of anchors 38 and 30. The anchors 38 and 40, which may be in the form of spikes, bolts or other devices known in the art. The anchors 38 and 40 pass through holes in the tabs 26" and 28" and are driven into the roof 36 in order to hold the outer shell 20 of the secondary support section 18 until the outer shell 20 is filled with a filler material. Once the filler material cures, the anchors 38 and 40 are no longer needed to hold the outer shell 20 in place as the outer shell 20 will be supported by the filler material to which it will bond. This bonding between the inside surface of the outer shell 20 and the filler material prevents the outer shell 20 from sliding back into the outer shell 14 of the primary support section 12 even if the anchors 38 and 40 become dislodged from the roof 36. It should be noted that while two tabs 26" and 28" are illustrated along with two anchors 38 and 40, it is further contemplated that one or more additional tabs and corresponding anchors could be utilized without departing from the spirit and scope of the invention.

Referring now to FIG. 4, once the support 10 is positioned and the outer shell 20 of the secondary support section 18 is raised and at least temporarily retained in place, a filling nozzle 42 is used to engage with the orifice or port 30 so that the upper secondary support section 18 can be filled with a compressible filler material, such as a lightweight grout or cement, a foam or other materials known in the art. The port 30 is positioned proximate the top edge 24 of the outer shell 20 so as to allow the outer shell 20 to be filled from the bottom to the top until completely filled. The secondary support section is filled until the filler material begins escaping between the roof 36 and the top edge 24 of the outer shell 20. This is possible since the roof 36 will not be perfectly smooth and thus there will be some small gaps between the roof 36 and the top edge 24 of the outer shell 20. Once it is evident by the escaping filler material around a substantial portion of the top edge 24 that the secondary support section 18 is completely filled with the filler material, the nozzle 42 can be removed. By using a filler material that is in an at least partially liquefied form that will quickly harden once pumped into the secondary support section 18, once cured, settling of the filler material can be minimized if not eliminated. Moreover, the adhesive properties of such materials are such that they will necessarily bind to the interior surface 44 of the outer shell 20 once cured or partially cured so as to prevent the outer shell 20 of the secondary support section 18 from slipping back into the primary support section 12 and away from the filler material contained within the secondary support section 18.

Figure 5:
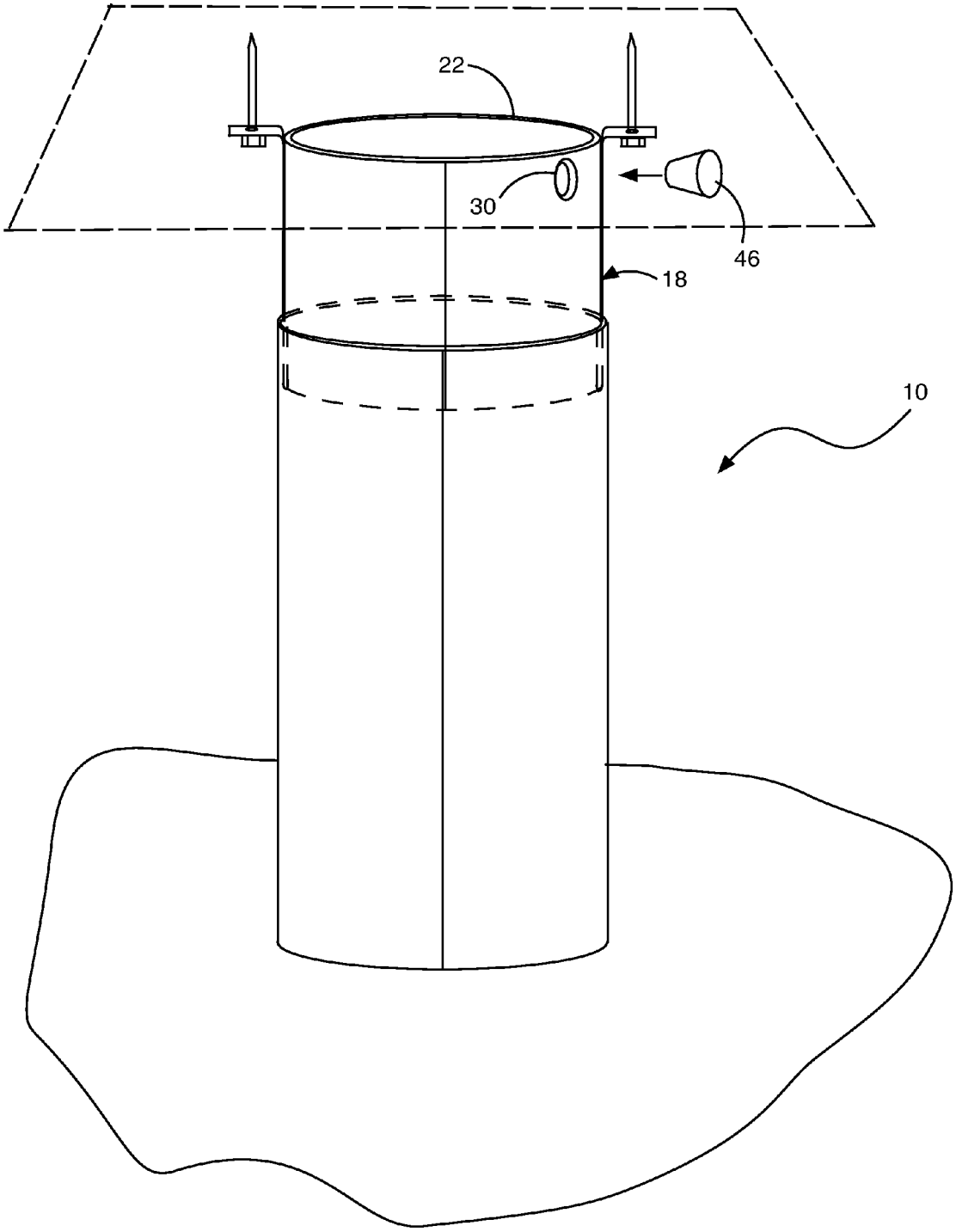
FIG. 5 is a perspective side view of the support shown in FIG. 1 in an extended state.

As shown in FIG. 5, once the upper secondary support section 18 has been filled with a filler material 22, the orifice or port 30 can be plugged with a tapered plug 46 that will prevent any filler material from escaping from the port 30. Alternatively, the port 30 can comprise a one-way valve structure that allows filler material to be pumped into the secondary support structure 18 while preventing the filler material from escaping back through the port 30 once the nozzle is removed. Those of skill in the art will appreciate that other mechanisms and/or structures may be used to effectively dose the port once the filling process is completed to prevent the filler material 22 from escaping through the port and such other mechanisms and/or structures are incorporated herein.

Figure 6:
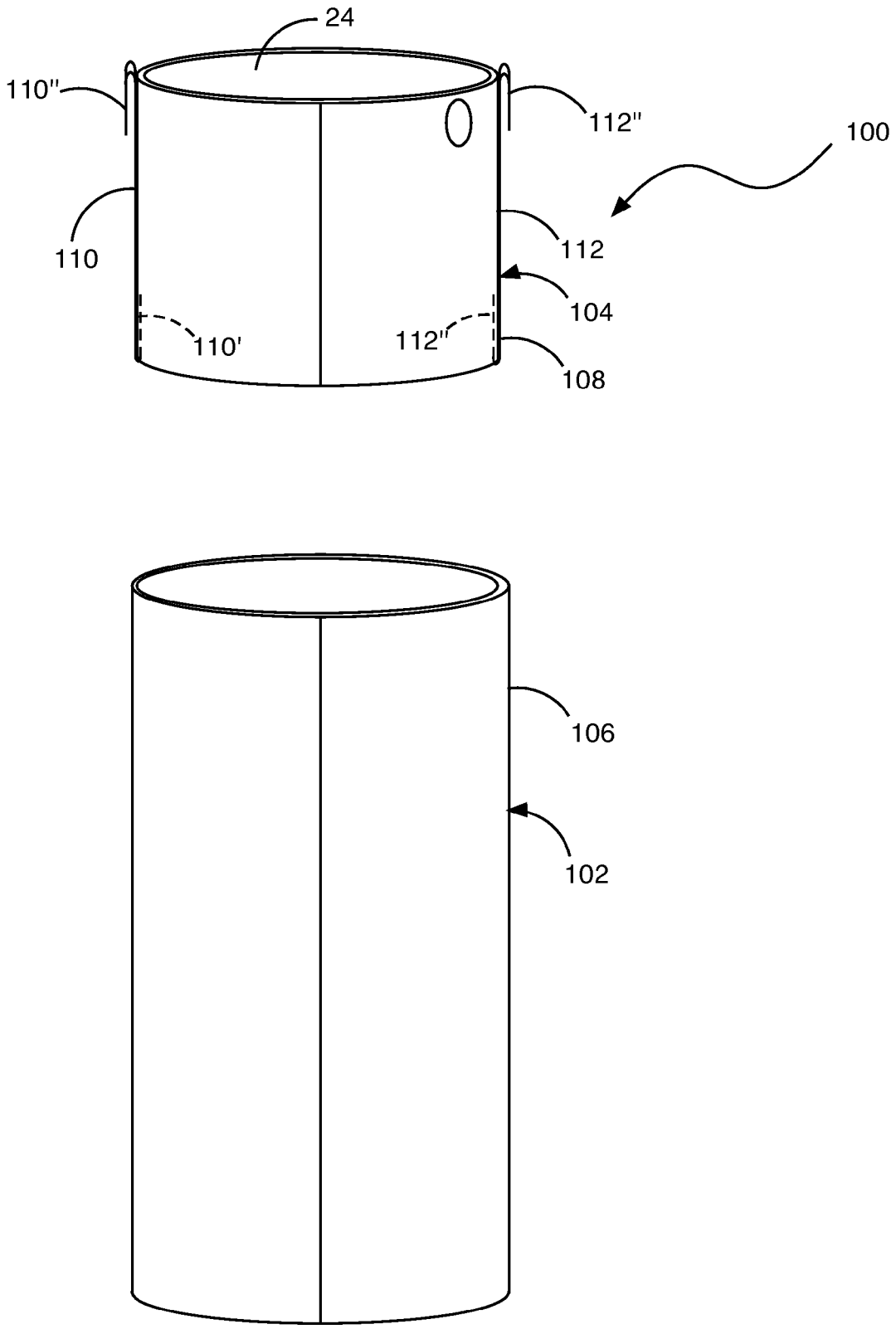
FIG. 6 is a perspective side view of a second embodiment of a support in accordance with the principles of the present invention.

FIG. 6 illustrates a second embodiment of a support generally indicated at 100 in accordance with the principles of the present invention. Similar to the support 10, the support 100 includes a lower support section 102 and an upper support section 104, each having a generally cylindrical configuration, although it is fully contemplated that structures of other cross-sectional geometric shapes are within the spirit and scope of the present invention. The outer shell 108 of the upper support section 104 fits within the outer shell 106 of the lower support section 102. Retaining and lifting straps 110 and 112 are coupled to the upper support section outer she 108 by having their lower ends 110' and 112' bent and wrapped around the lower edge 116. The upper ends 110" and 112" are downwardly bent with the bend being proximate the top edge 114 of the upper outer shell 108 and with the upper ends 110" and 112" being bent way from the outer shell 108. When the upper outer shell 108 fitted within the lower outer shell 106, the upper ends 110" and 112" of the straps 110 and 112 reside on the outside of the lower outer shell 106 and are folded relatively flat against the outer shell 106. Once positioned within a mine entry and when it is desired to lift the upper outer shell 108 into place, the upper ends 110" and 112" can be raised and, because they have a length sufficient for grasping by a user (e.g. about 6 inches or more) can be used to lift the upper outer shell 108 relative to the lower outer shell 106.

Figure 7:
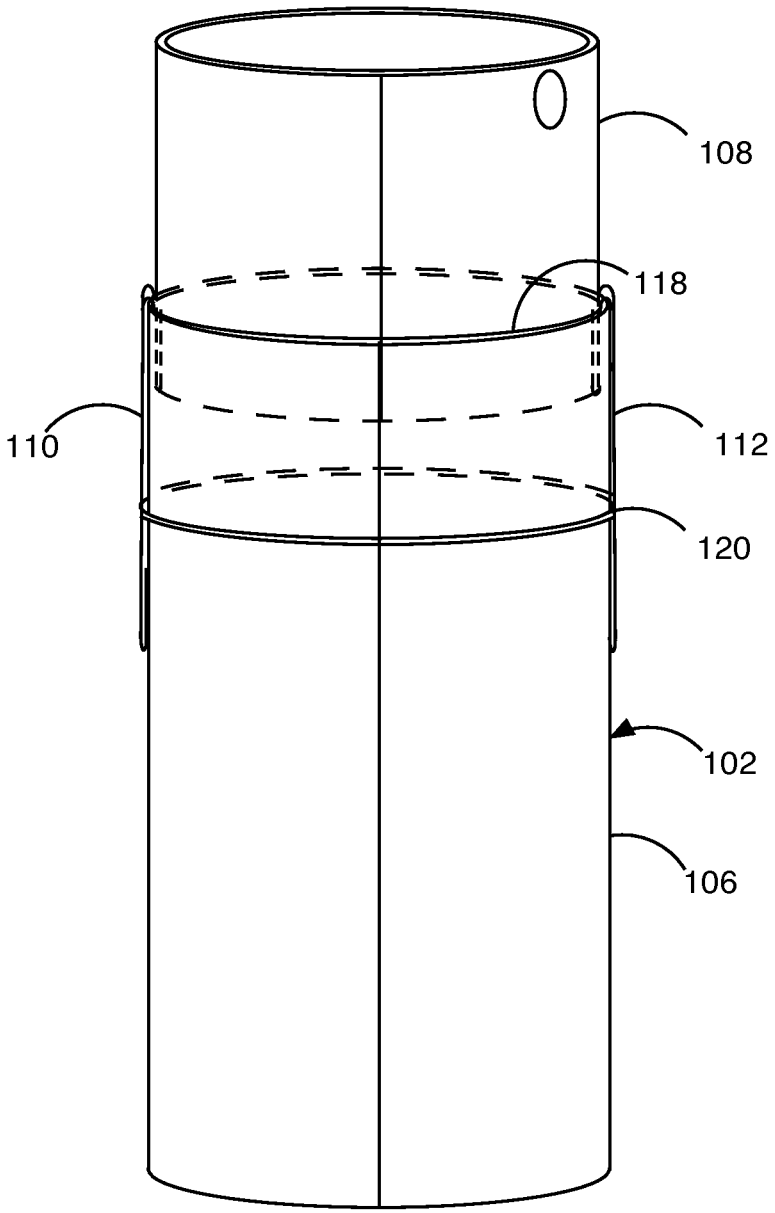
FIG. 7 is a perspective side view of the support shown in FIG. 6 in an extended state.

As further illustrated in FIG. 7, once the upper outer shell 108 is lifted to the desired height relative to the lower support section 102, the straps 110 and 112 can be bent at the upper edge 118 of the lower outer shell 106 until the straps 110 and 112 are positioned against the lower shell 106. A band 120, such as a nylon tie wrap or other similar structures known in the art, can then be placed around the lower outer shell 106 in order to hold the exposed portions of the straps 110 and 112 against the outer surface of the lower support section 102. In this configuration, the upper outer shell 108 does not need to be secured to the roof with the straps as illustrated with reference to the support 10.

Figure 8:
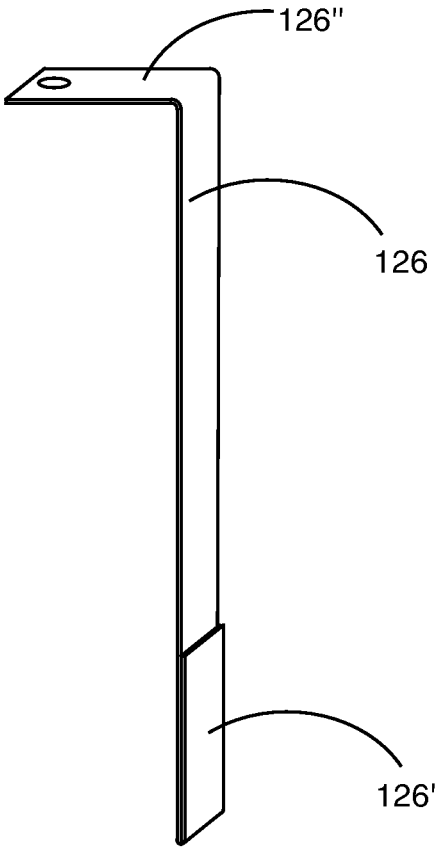
FIG. 8 is a perspective side view of an embodiment of a retaining member in accordance with the principles of the present invention.

The straps 110 and 112 are similarly configured to the attachment structures 26 and 28 illustrated in FIG. 1 but may not require holes to be bolted to the ceiling. In either case, as shown in FIG. 8, a securing strap 126 is comprised of an elongate metal strap having a lower end 126' that is upwardly bent so as to wrap around the lower end of the upper outer shell and an upper end 126" that is outwardly bent at an approximately 90 degree angle so as to be securable to a roof of a mine entry.

Figure 9:
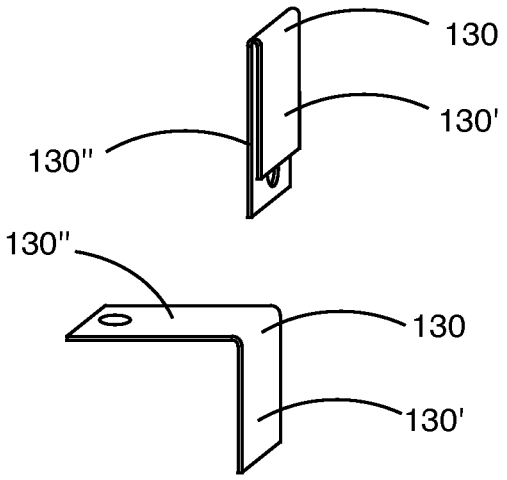
FIG. 9 are perspective sides view of another embodiment of a retaining member in accordance with the principles of the present invention

Conversely, as shown in FIG. 9, the securing g strap 126 may be in the form of a shortened securing strap 130 having a first portion 130' that can be attached proximate the top end of the upper outer shell as by welding or other methods known in the art. During transport, the shortened securing strap 130 can be bent flat upon itself with the second portion 130" folded against the first portion 130' if the first portion is attached to the outside surface of the upper support outer shell or folded against the outer shell if the first portion 130' is attached to an inside surface of the outer shell.

Figure 10:
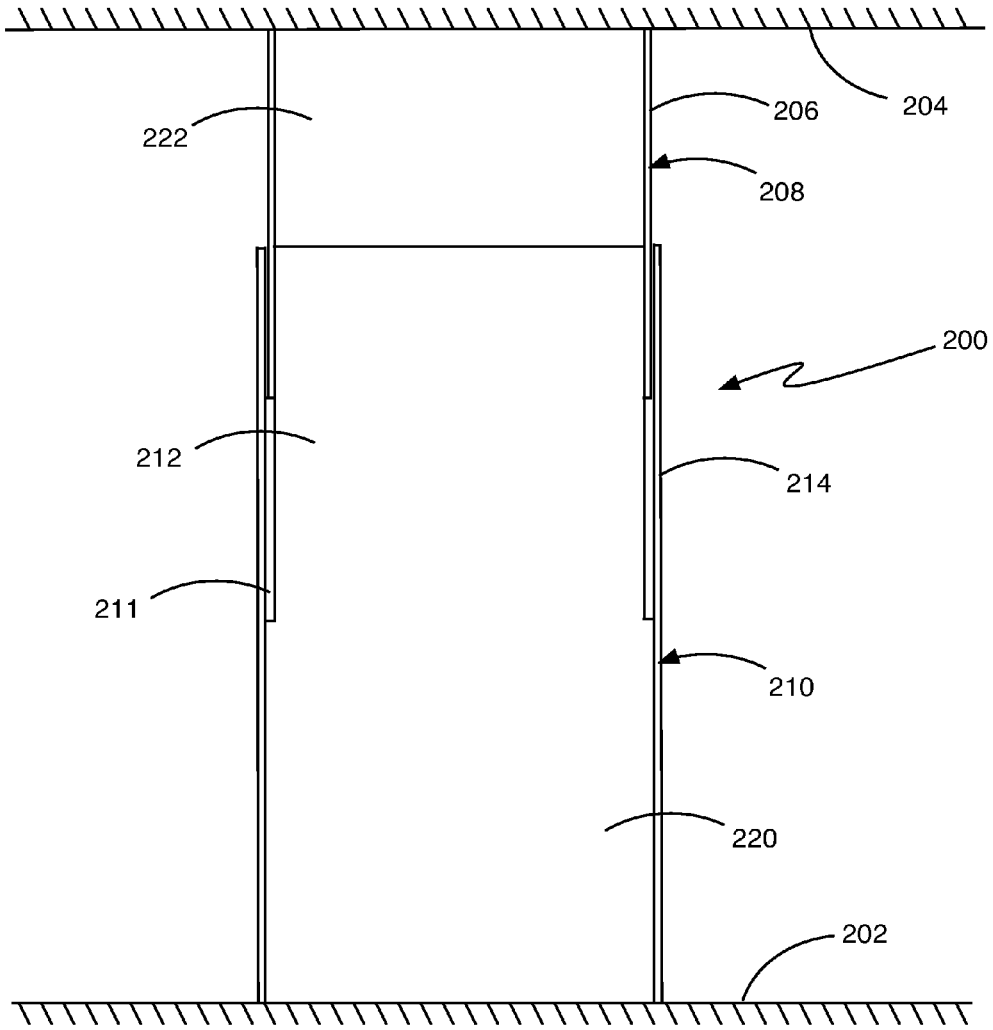
FIG. 10 is a cross-sectional side view of a third embodiment of a support in accordance with the principles of the present invention in a fully extended state within a mine entry.

Regardless of how the upper support section is secured in place relative to the roof and lower support section until filled, FIGS. 10-13 illustrate various stages of yielding of a support, generally indicated at 200 in accordance with the principles of the present invention. As shown in FIG. 10, the support 200 extends from the floor 202 to the roof 204. The outer shell 206 of the upper support section 208 has been raised to contact the roof 204 and bridge the gap between the lower support section 210 and the roof 204. A small circumferential gap 211 may exist between the filler material 212 of the lower support section 210 and the outer shell 214 of the lower support section 210 where the upper shell 206 resided prior to being lifted into place, but does not have any significant effect on the support characteristics of the support 200.

Figure 11:
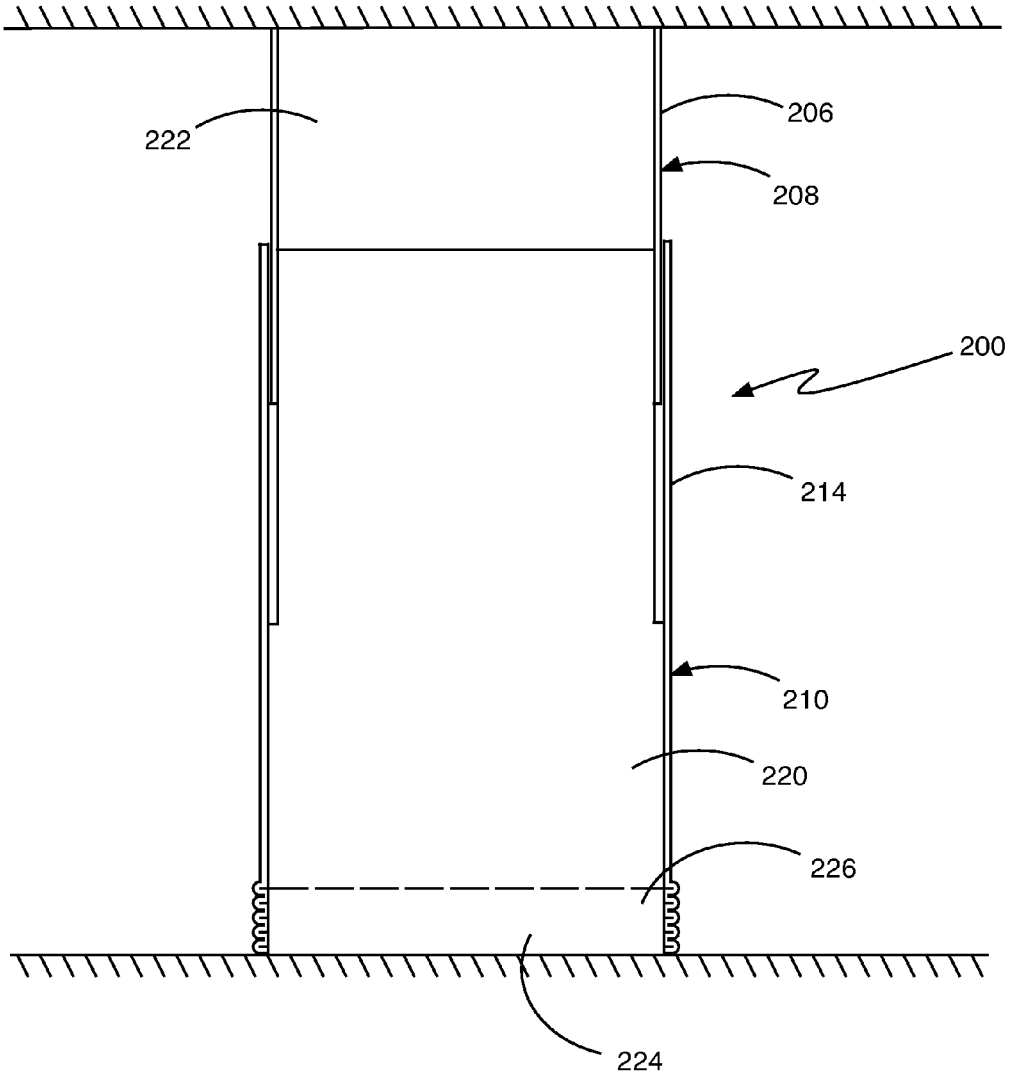
FIG. 11 is a cross-sectional side view of the support shown in FIG. 10 in a partially compressed state within a nine entry.
Figure 12:
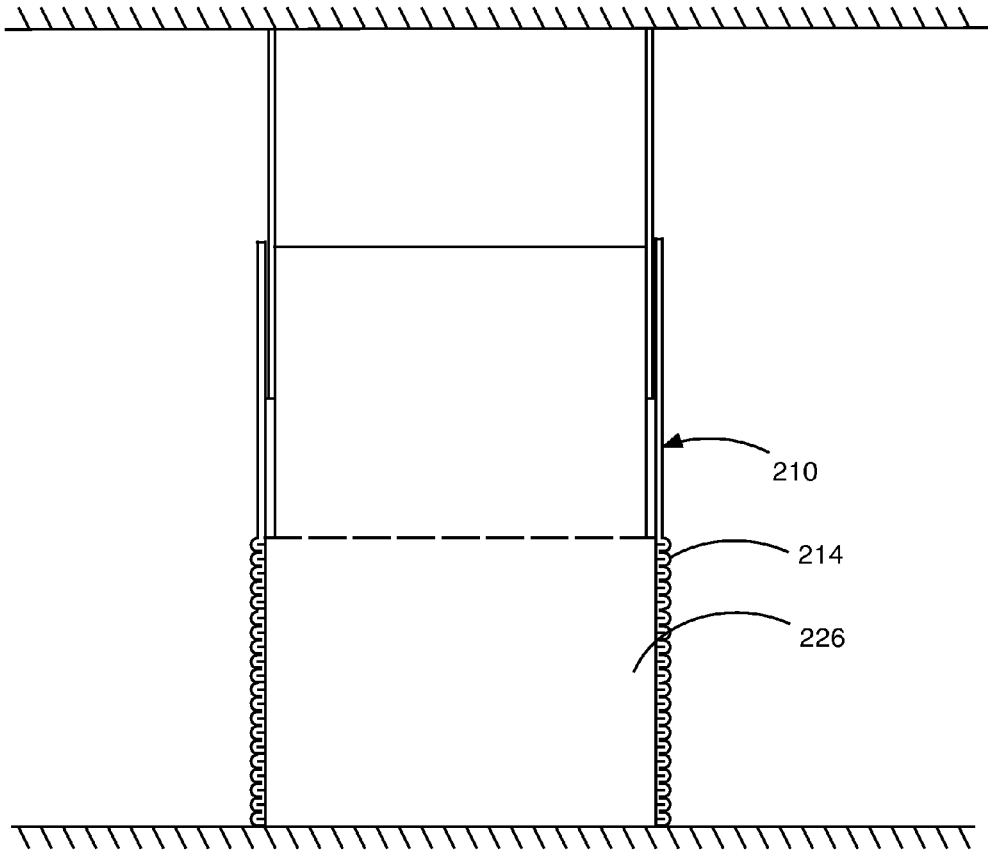
FIG. 12 is a cross-sectional side view of the support shown in FIG. 10 in a further partially compressed state within a mine entry.
Figure 13:
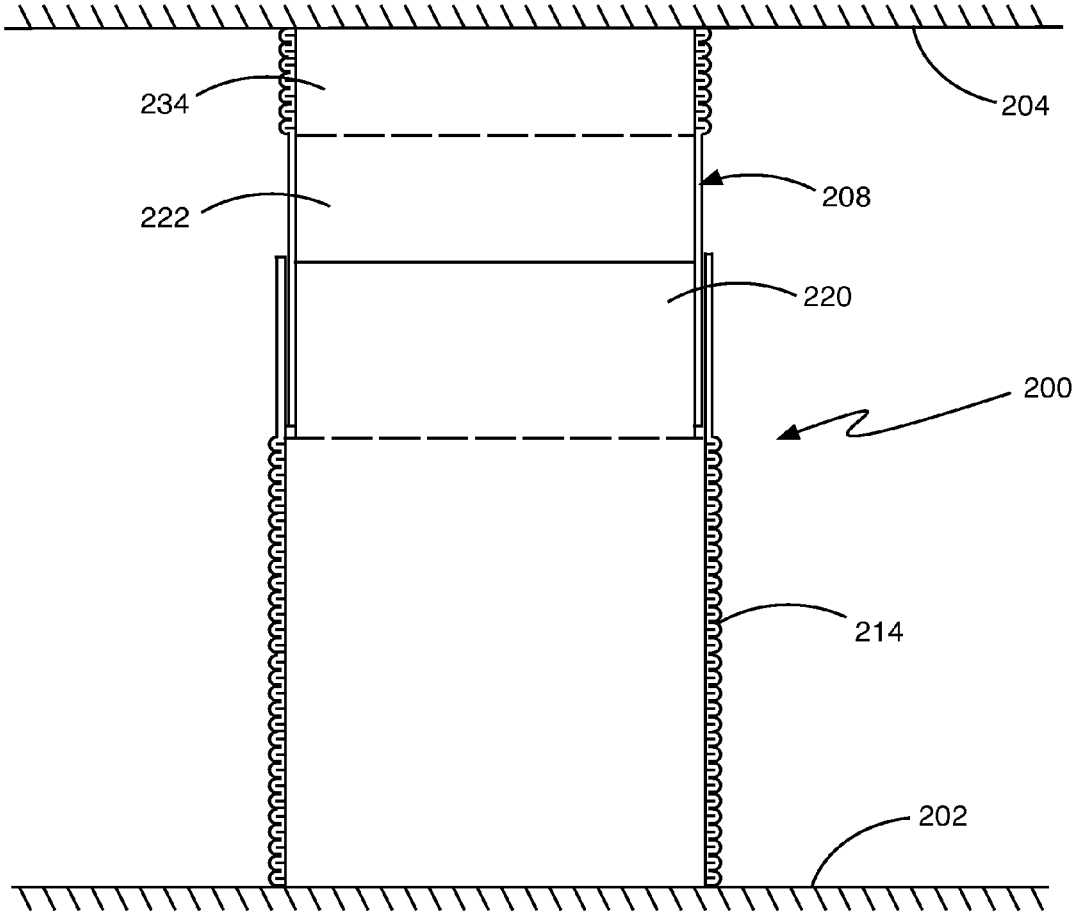
FIG. 13 is a cross-sectional side view of the support shown in FIG. 10 in a further partially compressed state within a mine entry.

The lower support section 210 is prefilled with a first filler material 220, such as a lightweight concrete, having a predetermined load bearing capability while yielding. The upper support section 208 is filled in situ with a second filler material 222 having a load bearing capability that is at least as great as the load bearing capability of the lower support section 210. By providing the upper support section 208 with a second filler material 222 that has a greater load bearing capacity than the first filler material 220 additional benefits and load bearing characteristics are realized. As shown in FIG. 11, as the support 200 first begins to yield, the support 200 is more likely to begin yielding from the bottom 224 of the support 200. The outer shell 214 will begin folding upon itself in an accordion-style manner due to plastic deformation of the outer shell 214 as illustrated and the filler material 220 will begin crushing to form a section 226 of higher density. Conversely, because the upper support section 208 is filled with a filler material 222 it will likely not begin yielding until the lower support section 210 has undergone significant yielding. It is also less likely that the top portion of the lower support section 210 will begin yielding where the outer shells 206 and 214 overlap since an effective double wall is formed that will provide additional load bearing strength along this section. As illustrated in FIG. 12, the lower section 210 will continue to yield along its length while the outer shell 214 maintains sufficient hoop strength to contain the compress filler 226 without bulging or lateral buckling. Once the lower section 214 has substantially been compressed as shown in FIG. 13 and a first yield limit has been reached, the upper section 208 will then begin yielding until a second yield limit is reached. Again the outer shell 206 will begin folding upon itself in an accordion-style manner due to plastic deformation of the outer shell 206 as illustrated and the filler material 222 will begin crushing to form a section 234 of higher density. Once the upper section 208 begins to yield, as can be visibly observed, mine operators are alerted that complete failure of the support 200 is approaching and that all personnel and mining equipment should be removed from the area. The support 200 will continue to yield to the second yield limit until the filler materials 220 and 222 are substantially fully compressed causing either the support 200 to fail or the support to effective punch through the roof or the floor in which case the roof will collapse around the support 200. At this point, however, the support has effectively performed as expected.

Figure 14:
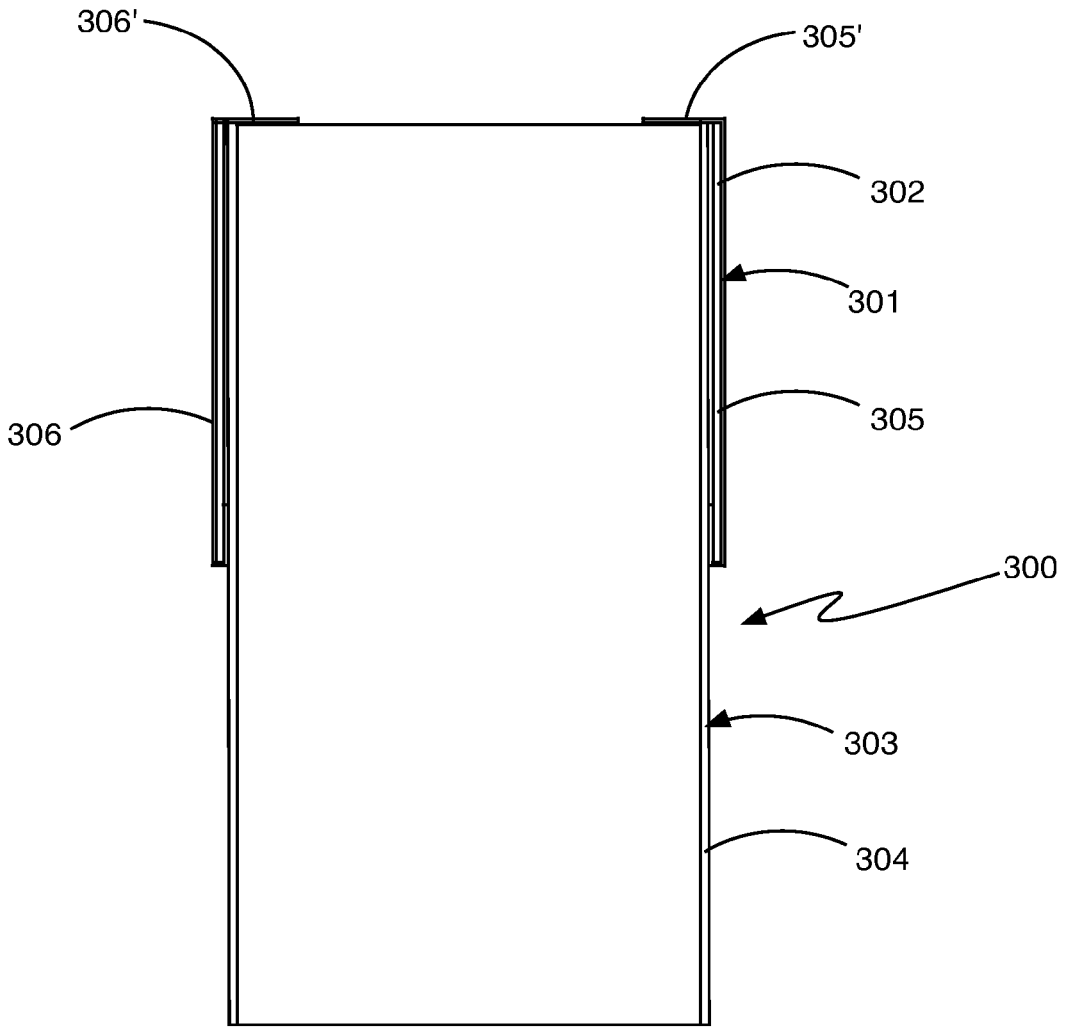
FIG. 14 is a cross-sectional side view of a fourth embodiment of a support in accordance with the principles of the present invention in a collapsed state.

While the foregoing illustrated embodiments show the outer shell of the upper support section being disposed within the lower support section, it is equally contemplated, as shown in FIG. 14 that a support 300 according to the present invention may comprise an outer shell 302 of an upper support section 301 that is disposed over the outer shell 304 of the lower support section 302. The retaining straps 305 and 305 are then disposed on the outside of the upper outer shell 302, wrap around the bottom of the upper outer shell 302 and have upper ends 305' and 306' that are inwardly bent over the lower support section 302. This maintains the upper outer shell 302 in position during transport by resting on the top end of the lower support section 302. During installation of the support 300, the upper ends 305' and 306' are bent 180 degrees relative to the side of the upper outer shell 302 and can be secured to the roof of the mine entry as previously described herein to hold the upper outer shell 302 in place until filled.

The supports of the present invention are designed to carry an average load of at least approximately between about 100,000 lbs and about 350,000 lbs depending on the size of the support. The primary support section includes a filler material formed from foamed concrete having density of approximately 40 to 50 lb/ft$^3$. The secondary support section includes a filler material formed from lightweight cement, grout our other materials known in the art having density of approximately 50 to 60 lb/ft$^3$. Each support section is comprised of an outer tube that is formed by sheet rolling techniques to form a tube from a flat sheet of steel. Such steel may have a thickness of approximately 0.075 to 0.09 inches of 1008 steel. The tube is then welded at a seam along the entire length of the tube. Likewise, each section may be formed by an extrusion process or other methods known in the art. The support generally will longitudinally yield when subjected to a longitudinal force or load. The support will yield in one or more yield zones by allowing the outer tube or shell to fold upon itself in a plurality of folds as the filler material compresses. Thus, the support longitudinally yields without releasing the load.

Various fillers and combinations of fillers may be employed in the supports. For example, the filler material may comprise aerated concrete mixtures of one or more densities. Likewise, the upper support section may include compressible fillers, such as pumas or hollow glass spheres that may be encapsulated within other binding agents or other materials, such as cement, grout or foam to hold the filler material together and to the inside of the outer shell.

Figure 15:
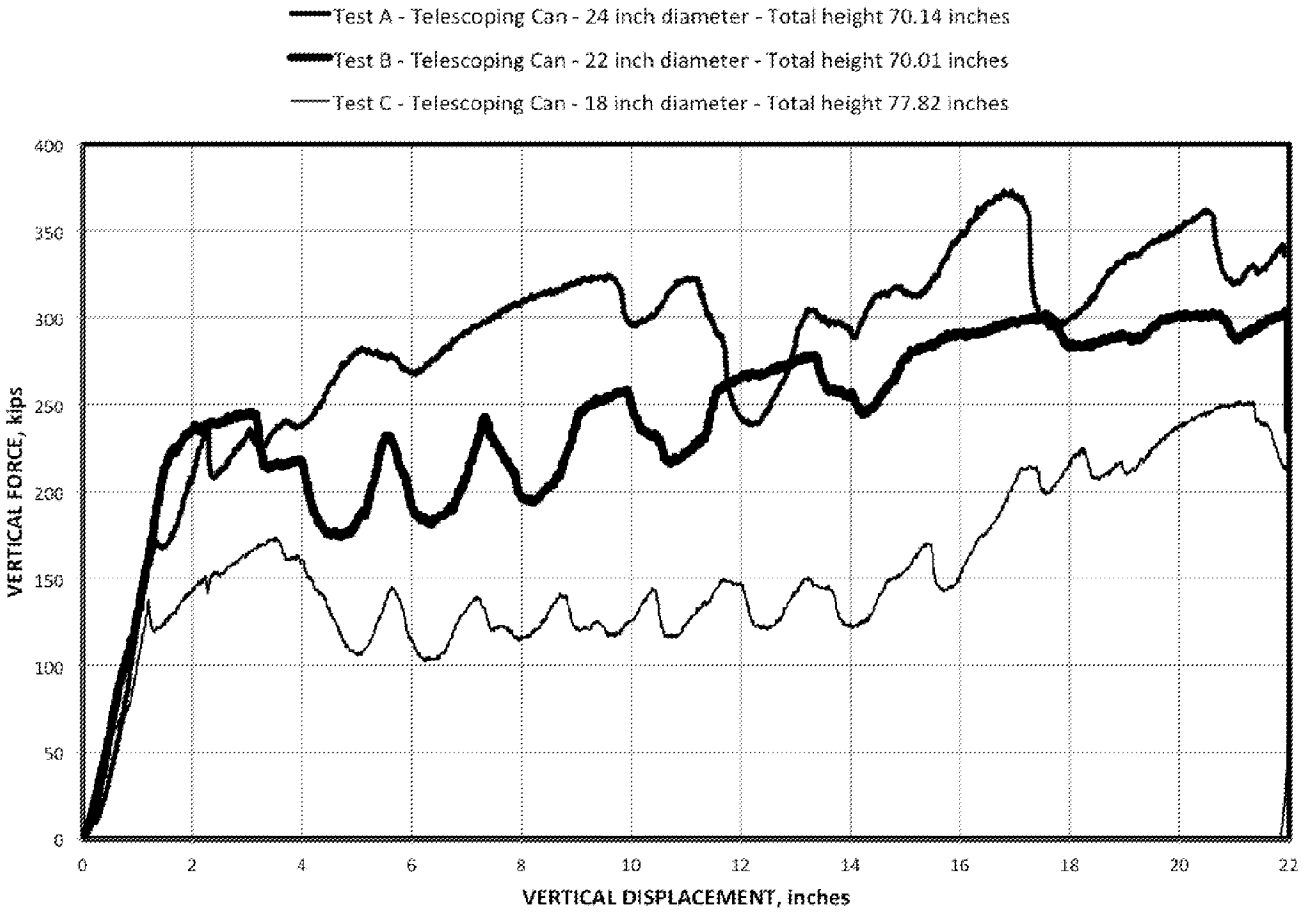
FIG. 15 is a graphical representation of test results illustrating support load versus displacement for a plurality of supports according to the principles of the present invention.

By way of example of the loads that can be supported by a support in accordance with the present invention, several tests have illustrated the impressive load supporting capabilities of the mine e support in accordance with the present invention. FIG. 14 is a graphical representation of actual test results conducted at the NIOSH Safety Structures Testing Laboratory. FIG. 15 shows the test results for three supports constructed in accordance with the principles of the present invention. Specifically, each support comprised a first section that was prefilled with a lightweight concrete. The second upper section was then raised and filled with a similar lightweight concrete mixture and allowed to cure. Once the upper secondary support section was properly cured, the support was then subjected to vertical force in the NIOSH mine simulator to compress the support and record the load bearing capability of each support. In Test A, represented by the upper, medium weight line, the support had a 24 inch diameter and a total height of 70.14 inches. After less than 2 inches of compression, the support was able to support a load of over 200 kips and continued to maintain that load bearing capacity over its entire range of yielding up to 22 inches of vertical displacement where the test was concluded. In fact, the average load bearing capacity of the Test A support actually increased from over 200 Kips to approximately 350 kips while continuing to yield. In Test B, represented by the middle, heavy weight line, the support had a 22 inch diameter and a total height of 70.01 inches. After less than 2 inches of compression, the support was able to support a load of over 225 kips and continued to maintain an average load bearing capacity of over 200 Kips for the entire duration of the test. Again, the average load bearing capacity of the Test B support increased from over 200 kips to approximately 300 Kips. This slightly lower load bearing capability of the Test B support is expected due to its smaller diameter as compared to the Test A support. In Test C, represented by the lower, light weight line, the support had an 18 inch diameter and a total height of 77.82 inches. In this test, the Test C support began bearing a load of over 125 Kips in less than 2 inches of compression. The Test C support was able to support an average load of at least 125 kips over the entire test. While maintaining a more gradual increase in load bearing capacity for the first 14 inches of compression compared to the other tests, the Test C support continued to increase its load bearing capacity over the duration of the test with a final load bearing capacity at the end of the test of between 200 and 250 Kips. As illustrated by the tests, each support is able to support a significant load within 2 inches of compression. Prior art supports that use wood planks to fill the gap between the top of the support and the roof will typically allow more movement before the same load bearing capacity is reached.

Accordingly, each test support behaved in a predictable manner that continued to yield while supporting at least a particular load and that yielded a short distance before a significant load bearing capacity was realized. This allows mine engineers to place the supports at various locations and distances throughout a mine entry where the loads to be supported are relatively predictable, with the assurance that very little movement of the roof will occur before the support is fully loaded. Moreover, because each support gradually increases in load bearing capacity while continuing to yield, there is no unexpected drop in load bearing capacity of the supports that could result in a localized failure. With respect to each test, the data shows a sine-type wave pattern where the load bearing capacity varies as the support is compressed. This is a result of the folding of the outer shell of the support. That is, when the outer shell of the support is experiencing plastic deformation when the shell is forming a fold, the load bearing capacity will decrease slightly until the fold is complete at which point the load bearing capacity will slightly increase. This repeats with each successive fold of the outer shell of the support until the support has reached its maximum compression (typically about half its original height). As illustrated, however, while the occurrence of each fold changes the load bearing capacity of the support, the upper and lower load bearing capacity of the support during and after a fold is within a relatively constant range, again producing a predictable load bearing capacity of the support even as the support yields.

The supports according to the present invention can also maintain a support load of even during several inches of vertical displacement of the upper end of the support relative to the bottom end. This allows the support to continue to bear a load even if the floor and roof of the mine entry laterally shift relative to one another. Thus, even in a condition where horizontal shifting of the mine roof or floor occurs, the mine support according to the present invention continues to support significant loads.

While the present invention has been described with reference to certain illustrative embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. It should be noted that reference to the terms "shell" or "tube" are intended to cover sheds or tubes of all cross-sectional configurations including, without limitation, round, square, or other geometric shapes. In addition, reference herein to a use of the support in a mine entry or underground mine according to the present invention is not intended in any way to limit the usage of the support of the present invention. Indeed, the support of the present invention may have particular utility in various tunnel systems or other applications where a yieldable support post is desired. The claims provided herein are intended to cover such modifications and combinations and all equivalents thereof. Reference herein to specific details of the illustrated embodiments is by way of example and not by way of limitation.

What is claimed is:

1. A longitudinally yieldable support for a mine entry, comprising:

a first support section comprising a first elongate outer shell substantially filled with a first solid compressible filler material; and a second support section comprising a second elongate outer shell extending above the first elongate outer shell and telescopically engaged therewith, the second elongate outer shell having a first diameter that is different than a second diameter of the first elongate outer shell to allow the second elongate outer shell to engage with the first elongate outer shell and upwardly slide relative to the first elongate outer shell in a telescopic manner, the second support section having a length sufficient to remain in engagement with the first support section when a top of the second elongate outer shell abuts against a roof of a mine entry and a bottom of the first support section is supported by a floor of the mine entry, the second elongate outer shell substantially filled from a top of the first solid compressible filler to proximate the top of the second elongate outer shell with a second compressible filler material in solid form having a density that is at least about as great as a density of the first solid compressible filler material; and at least one attachment member comprised of an elongate strap coupled to a lower end of the second elongate outer shell, the at least one attachment member configured to hold the second elongate outer shell above the first elongate outer shell while a portion of the second elongate outer shell is filled with the second compressible filler and at least until the second compressible filler cures into a solid within the second elongate outer shell at which time the second compressible filler holds the second elongate outer shell relative to the first elongate outer shell, the at least one attachment member including a securing portion that laterally extends relative to the top of the second elongate outer shell with the securing portion configured for attachment to the roof.

2. The support of claim 1, wherein the at least one attachment member is coupled to the second elongate outer shell by wrapping around the lower end thereof.

3. The support of claim 1, wherein the at least one attachment member secures the second elongate outer shell relative to the first elongate outer shell.

4. The support of claim 1, wherein the at least one attachment member is configured for lifting the second elongate outer shell relative to the first elongate outer shell and configured for securing the second elongate outer shell to the roof once lifted.

5. The support of claim 1, wherein the first elongate outer shell is comprised of steel and wherein the second elongate outer shell is comprised of steel and has a length that is less than a length of the first elongate outer shell.

6. The support of claim 5, wherein the second elongate outer shell is movable from a first position in which the second elongate outer shell is at least partially disposed within the first elongate outer shell to a second position in which a portion of the second elongate outer shell is positionable between the first elongate outer shell and a roof of a mine entry with a lower portion of the second elongate outer shell disposed within the first elongate outer shell.

7. The support of claim 5, wherein the second elongate outer shell is movable from a first position in which the second elongate outer shell is at least partially disposed over the first elongate outer shell to a second position in which a portion of the second elongate outer shell is positionable between the first elongate outer shell and the roof of the mine entry with a lower portion of the second elongate outer shell disposed over the first elongate outer shell.

8. The support of claim 1, wherein the first compressible filler material has a first density and the second compressible filler material once cured is comprised of a solidified compressible material having a second density that is greater than the first density of the first compressible filler material, to cause the first compressible filler to yield before the second compressible filler yields under load.

9. The support of claim 1, wherein a portion of the at least one attachment member is bent over a top edge of the first elongate outer shell to maintain the second elongate outer shell relative to the first elongate outer shell.

10. The support of claim 9, wherein the first compressible filler material has a density of between about 40 and 50 $lb/ft^3$ and the second compressible filler material has a density of between about 50 and 60 $lb/ft^3$.

11. The support of claim 10, wherein the first support section will yield first under load until a first yield limit is reached at which time the second support section will begin to yield.

12. The support of claim 11, wherein the first support section is capable of supporting a load of at least 100,000 lbs.

13. The support of claim 10, wherein the first support section is capable of supporting a load of between approximately 100,000 lbs and 300,000 lbs as the first support section yields under load.

14. The support of claim 11, wherein the second outer shell will fold upon itself as the second support section yields and the first outer shell will fold upon itself as the first support section yields.

15. A longitudinally yieldable support for supporting a roof in an underground mine, comprising:

a first cylindrical support section comprising a first elongate outer shell comprised of metal substantially filled with a first solid lightweight concrete having a first density;

a second cylindrical support section comprising a second elongate outer shell comprised of metal extending above the first elongate outer shell, the second elongate outer shell having a second diameter that is different than a first diameter of the first elongate outer shell to allow the second elongate outer shell to slide in a telescopic manner relative to the first elongate outer shell, the second elongate outer shell filled in situ with a second lightweight concrete in liquid form, the second lightweight concrete once cured having a second density that is greater than or equal to the first density of the first solid lightweight concrete; and a plurality of attachment members coupled to the second elongate outer shell and configured for securing the second elongate outer shell relative to the first elongate outer shell once extended relative to the first elongate outer shell in the telescopic manner, the plurality of attachment members each comprised of an elongate metal strap that wraps around a lower end of the second elongate outer shell.

16. The support of claim 15, wherein each of the plurality of attachment members comprises a securing portion for securing the second elongate outer shell relative to the first elongate outer shell.

17. The support of claim 15, wherein the second elongate outer shell is movable from a first position in which the second elongate outer shell is substantially disposed within the first elongate outer shell to a second position in which a portion of the second elongate outer shell is positioned between the first elongate outer shell and a roof of a mine entry with a lower portion of the second elongate outer shell disposed within the first elongate outer shell.

18. The support of claim 15, wherein the second elongate outer shell is movable from a first position in which the second elongate outer shell is at least partially disposed over the first elongate outer shell to a second position in which a portion of the second elongate outer shell is positioned between the first elongate outer shell and a roof of a mine entry with a lower portion of the second elongate outer shell disposed over the first elongate outer shell.

19. The support of claim 15, wherein the first lightweight concrete has a first density and the second lightweight concrete has a second density that is greater than or equal to the first density of the first lightweight concrete.

20. The support of claim 15, wherein the securing portion of each of the pair of attachment strap members laterally extends relative to a top end of the second elongate outer shell and includes a hole configured for attaching the securing portion to a mine roof.

21. The support of claim 15, wherein each of the plurality of attachment members are bent over a top edge of the first elongate outer shell to maintain the second elongate outer shell relative to the first elongate outer shell.

22. The support of claim 15, wherein the first support section is configured to yield under load until a first yield limit is reached at which time the second support section will begin to yield.

23. The support of claim 22, wherein the second outer shell will fold upon itself as the second support section yields and the first outer shell will fold upon itself as the first support section yields.

* * * * *